US007795948B2

(12) United States Patent
Gilbert

(10) Patent No.: US 7,795,948 B2
(45) Date of Patent: Sep. 14, 2010

(54) SUPER-SYMMETRIC MULTIPLIER

(75) Inventor: Barrie Gilbert, Portland, OR (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 11/768,142

(22) Filed: Jun. 25, 2007

(65) Prior Publication Data

US 2008/0252355 A1 Oct. 16, 2008

Related U.S. Application Data

(60) Provisional application No. 60/912,158, filed on Apr. 16, 2007.

(51) Int. Cl.
*G06G 7/12* (2006.01)

(52) U.S. Cl. ..... 327/355; 327/361; 327/359; 327/349

(58) Field of Classification Search ..... 327/346–349, 327/355–361; 455/326, 333
See application file for complete search history.

(56) References Cited

U.S. PATENT DOCUMENTS 5,589,791 A 12/1996 Gilbert
5,926,408 A * 7/1999 Kimura ..... 708/835
5,986,494 A * 11/1999 Kimura ..... 327/359
6,204,719 B1 * 3/2001 Gilbert ..... 327/349
6,437,630 B1 8/2002 Gilbert
6,456,142 B1 * 9/2002 Gilbert ..... 327/356
6,549,057 B1 * 4/2003 Gilbert ..... 327/349
2003/0030478 A1 2/2003 Gilbert
2004/0164784 A1 8/2004 Umeda

OTHER PUBLICATIONS

Barrie Gilbert, The Multi-tanh Principle: A Tutorial Overview, IEEE Journal of Solid-State Circuits, Jan. 1998, pp. 2017, vol. 33, No. 1, Institute of Electrical and Electronics Engineers, New York, NY, USA.
Analog Devices AD830 High Speed, Video Difference Amplifier, Jan. 2003, Analog Devices, Inc., Norwood, MA, USA.
Analog Devices AD835 250 MHz, Voltage Output 4-Quadrant Multiplier, Jun. 2003, Analog Devices, Inc., Norwood, MA, USA.
Analog Devices AD734 10MHz, 4-Quadrant Multiplier/Divider, Oct. 1999, Analog Devices, Inc., Norwood, MA, USA.
Analog Devices MT-079 Tutorial, Analog Multipliers, Oct. 2008, Analog Devices, Inc., Norwood, MA, USA.
International Search Report, PCT/US08/60341.

* cited by examiner

*Primary Examiner*—Dinh T. Le
(74) *Attorney, Agent, or Firm*—Marger Johnson & McCollom PC

(57) ABSTRACT

A circuit includes a multi-tanh cell having a common-emitter node to receive a bias current, and an extra transistor coupled to the common-emitter node to dynamically divert a portion of the bias current from the multi-tanh cell. The circuit may be arranged as a multiplier with an input network arranged to apply two or more input signals to the multi-tanh cell. A second multi-tanh cell with an extra transistor may be arranged in a feedback loop where the outputs of the first and second multi-tanh cells are coupled together at an integrating node. A buffer drives the final output and feedback cell to cancel nonlinearities in the multiplier cells.

16 Claims, 3 Drawing Sheets

SUPER-SYMMETRIC MULTIPLIER

This application claims priority from U.S. Provisional Patent Application Ser. No. 60/912,158 having the same title and filed Apr. 16, 2007 which is incorporated by reference.

BACKGROUND

FIG. 1 illustrates a prior art four-quadrant multiplier based on a common-emitter multi-tanh transistor cell. The circuit of FIG. 1 includes a core of four transistors Q1-Q4 having their emitters connected together at a common node N1. A current source $I_T$ is connected to N1 to provide a bias current (or "tail current") for transistors Q1-Q4. The X and Y inputs are applied to a network of input resistors R1-R8 as differential voltages $\pm V_X$ and $\pm V_Y$. The collectors of Q1 and Q4 are connected together to provide a first output current $I_M$, and the collectors of Q2 and Q3 are connected together to provide a second output current $I_P$ which, in combination with $I_M$, provides a differential output signal $I_{OUT}$. The scaling of the multiplier is set by the value of $I_T$ which determines the transconductance of the entire multiplier. Thus, the bias current may be utilized as a third multiplying input.

The signals at the bases of Q1-Q4 are designated as X+Y, X−Y, Y−X and −X−Y, respectively. The variables X and Y are defined as $X=V_X/2V_T$ and $Y=V_Y/2V_T$, where $V_T$ is the thermal voltage kT/q. Thus, X and Y are normalized dimensionless variables. The need for the factor 2 in the denominator is apparent from FIG. 1; for example, if $+V_X$ is held constant and $+V_Y$ is increased by some amount, one-half of the increase is applied to the base of Q1.

For a generalized common-emitter multi-tanh transistor cell having N transistors, the collector currents bear the following relationships:

$$I_K = \frac{\exp(V_K/V_T)}{\sum_{K=1}^{K=N} \exp(V_K/V_T)} I_T \qquad \text{(Eq. 1)}$$

Inserting the base voltages and adding the collector currents with the appropriate phasing as shown in FIG. 1, we have $$I_{OUT} = \frac{\exp(X+Y)+\exp(-X-Y)-\exp(-X+Y)-\exp(-X-Y)}{\exp(X+Y)+\exp(-X-Y)+\exp(-X+Y)+\exp(-X-Y)} I_T \qquad \text{(Eq. 2)}$$

Using the truncated expansion $\exp(u)\approx 1+u+u^2/2$ for the exponential functions of the individual transistors it can be shown that the differential output current $I_{OUT}$ may be approximated as follows:

$$I_{OUT} \approx \frac{XY}{1+(X^2+Y^2)/2} I_T \qquad \text{(Eq. 3)}$$

The product term $(X^2+Y^2)$ diminishes when X and Y are relatively small, and thus the equation collapses to $I_{OUT}\approx XYI_T$ which provides a useful multiplication function at low input signal levels. As the magnitude of the X or Y input increases, however, the product term $(X^2+Y^2)$ in the denominator of Eq. 3 increases to the point that the approximation breaks down. In a typical implementation, the multiplier of FIG. 1 has an acceptably linear input range of about ±40 mV, beyond which, the behavior starts to enter a limiting domain of operation.

DETAILED DESCRIPTION

Figure 1:
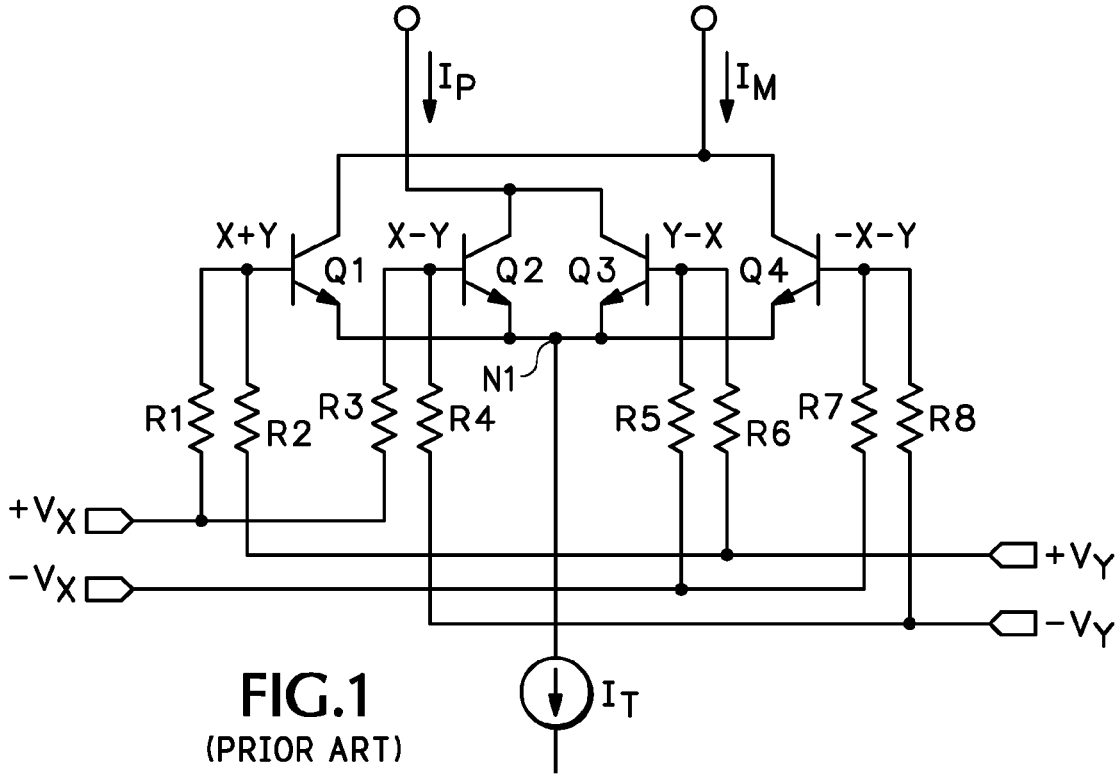
FIG.1 (PRIOR ART)
FIG. 1 illustrates a prior art four-quadrant multiplier based on a common-emitter multi-tanh transistor cell.

To gain a better understanding of the inventive principles of this patent disclosure, some of the salient aspects of the prior art will first be discussed with reference to FIG. 1. One possible approach to increasing the linear input range of the circuit of FIG. 1 would be to utilize larger input signals, and then scale the inputs down to operate within the linear range of the multiplier. However, there are at least two disadvantages to such an approach. First, mismatches in the transistors become increasingly important at low signal levels. Thus, operating with only a few millivolts of swing would be problematic. Second, the noise floor, which is determined predominantly by the emitter current and the input resistors R1-R8, does not change as the input signals are scaled down. This sets a practical limit on the lower end of the useful input signal range.

Another possible approach to increasing the linear input range of a multi-tanh cell involves the use of transistors having different emitter areas. However, in the circuit of FIG. 1, any variation in transistor sizes would destroy the symmetry and balance which are important in a multiplier. Likewise, any variation in the resistor ratios in the input resistor matrix would upset the function of the circuit which is fundamentally a matter of balancing and sharing the various input voltages.

Figure 2:
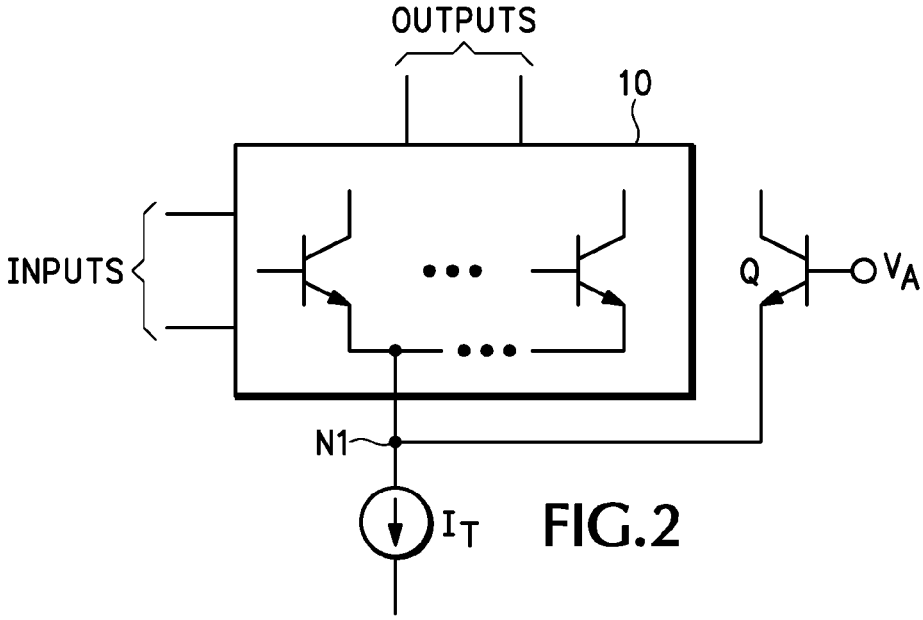
FIG. 2 illustrates an embodiment of a multi-tanh circuit according to some of the inventive principles of this patent disclosure.

FIG. 2 is a conceptual illustration of a multi-tanh circuit that may overcome some of these problems according to the inventive principles of this patent disclosure. The circuit of FIG. 2 includes a common-emitter multi-tanh cell 10 having any suitable number of transistors arranged in an appropriate topology. Although a particularly useful embodiment with a four-transistor multi-tanh cell will be described below, the inventive principles are not limited to any particular type of multi-tanh cell. See, e.g., The Multi-tanh Principle: A Tutorial Overview, *IEEE Journal of Solid-State Circuits*, Vol. 33, No. 1, January 1998, by the inventor of the present patent disclosure.

A tail current $I_T$ is coupled to the common emitter node N1 to bias the multi-tanh cell 10, thereby setting the initial (or nominal) transconductance of the cell. However, an extra transistor Q is coupled to the common emitter node and arranged to dynamically divert a portion of the tail current from the multi-tanh cell. In this example, the emitter of Q is coupled to the common emitter node, the collector is attached to a point such a power supply where the diverted tail current may be routed, and the base is anchored to any suitable point that may, for example, be responsive to the inputs of the multi-tanh cell.

By diverting a portion of the tail current at low input signal levels, the extra transistor may increase the compliance of the common emitter node. For example, a conventional multi-tanh cell may be designed to operate with a certain amount of tail current $I_{T1}$. By adding the extra transistor Q, the value of $I_T$ may be increased to provide an additional amount of tail current $I_{T2}$ which is normally diverted by Q. Thus, the tail current is normally split between the multi-tanh cell and the extra transistor Q. However, when the magnitude of one or more of the input signals increases to a level that would exceed the linear input range of the multi-tanh cell, some of the additional tail current $I_{T2}$ may be redirected back from Q to the multi-tanh cell, thereby extending the linear input range. Moreover, this increase in linear range may be obtained without increasing the noise floor as discussed below.

Figure 3:
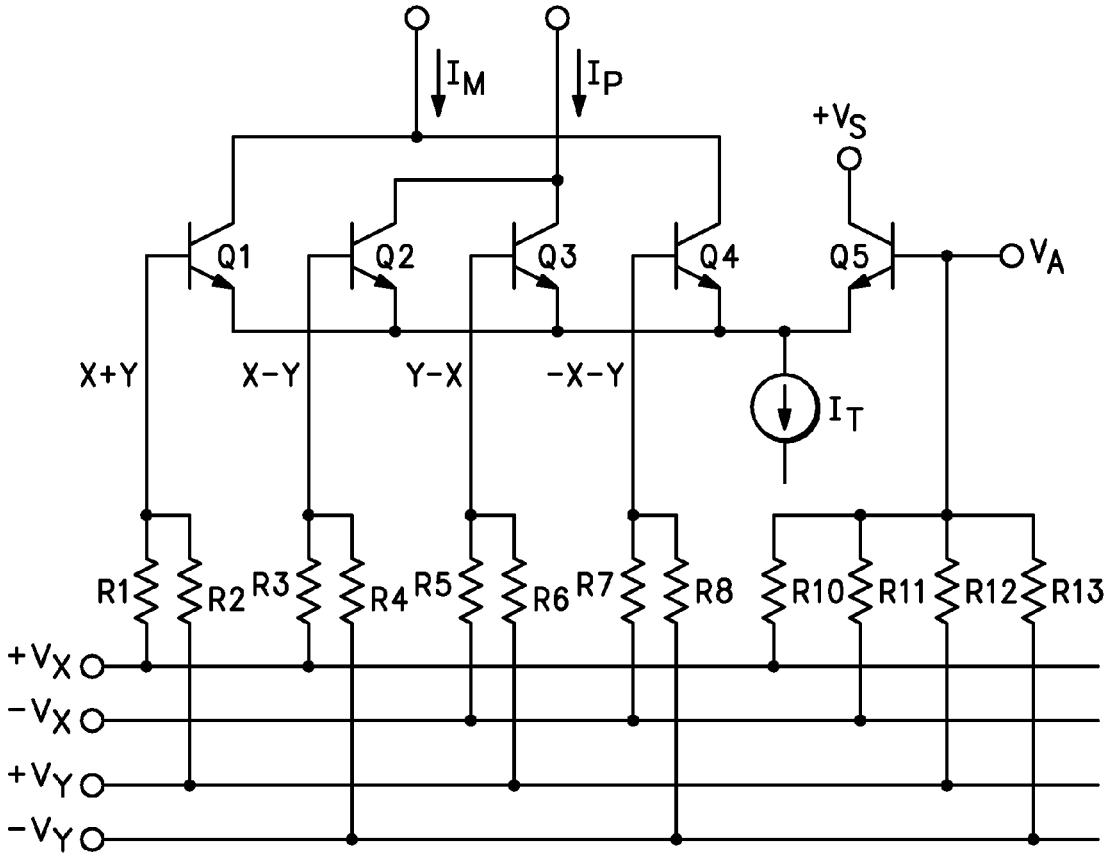
FIG. 3 illustrates an embodiment of a four-quadrant multiplier according to some of the inventive principles of this patent disclosure.

FIG. 3 illustrates an embodiment of a four-quadrant multiplier according to some of the inventive principles of this patent disclosure. The circuit of FIG. 3 includes a common-emitter multi-tanh core Q1-Q4 and input network R1-R8 arranged as in a conventional multiplier. However, the circuit includes an extra transistor Q5 having an emitter coupled to the common emitter node N1, a collector coupled to supply voltage $+V_S$ and a base anchored to a point $V_A$ which is driven by a signal representing the mean of the input signals. In this example, the mean is provided by coupling the base of Q5 back to the inputs $+V_X$, $-V_X$, $+V_Y$ and $-V_Y$ through resistors R10-R13, respectively.

Because the extra transistor Q5 is outside of the multi-tanh core, its size may be varied relative to the other transistors without destroying the symmetry of the core. A variable K may be defined as the emitter area of Q5 relative to the emitter areas of transistors Q1-Q4. Eq. 2 may then be modified as follows:

$$I_{OUT} = \frac{\exp(X+Y)+\exp(-X-Y)-\exp(-X+Y)-\exp(-X-Y)}{\exp(X+Y)+\exp(-X-Y)+\exp(-X+Y)+\exp(-X-Y)+K} I_T \quad \text{(Eq. 4)}$$

The linearity of this function with respect to either X or Y may be considerably enhanced for K>0 which may be implemented by the extra transistor Q5.

The expansion of exp(u) used to generate the approximation for Eq. 3 is less accurate here, but as a rough guide, the result is $$I_{OUT} \approx \frac{XY}{1+K/4+(X^2+Y^2)/2} I_T \quad \text{(Eq. 5)}$$

Although the approximation of Eq. 5 is not as analytically rigorous as the approximation of Eq. 3, it is still useful for conceptualizing the effect of the emitter area ratio K on the operation of the circuit. The output may be described as being "diluted" in a sense by the factor (1+K). That is, K works by diluting the nonlinearity of $X^2+Y^2$ in the denominator. As K increases, more of the tail current under quiescent conditions is diverted by Q5. Increasing the value of K enables the circuit to accommodate large input signal swings.

To better illustrate these effects, some example vales will be assigned to the variables. For purposes of illustration and computational simplicity, Q5 will be assumed to have an emitter area of 9 units, while Q1-Q4 are assumed to have emitter areas of 1 unit each. Thus, K=9 in this example, and all 5 transistors have a combined emitter area of 13 unites. Also, the tail current $I_T$ is assumed to have a nominal value of 13 milliamps. Under quiescent conditions, 1/13th of the total tail current, or 1 mA, flows through each of Q1-Q4, and 9/13ths of the total tail current, or 9 mA, flows through Q5. Therefore, the total common mode current coming out of the multiplier core is 4/13ths of the total tail current. This might initially seem to indicate worse noise performance because the output is reduced, but the noise would seem to be worsened by partition noise. However, the partition effect only affects the common mode noise which is related to the total current coming out of Q1-Q4. Thus, the presence of Q5 extends the upper end of the linear input range without increasing the noise floor at the lower end.

Figure 4:
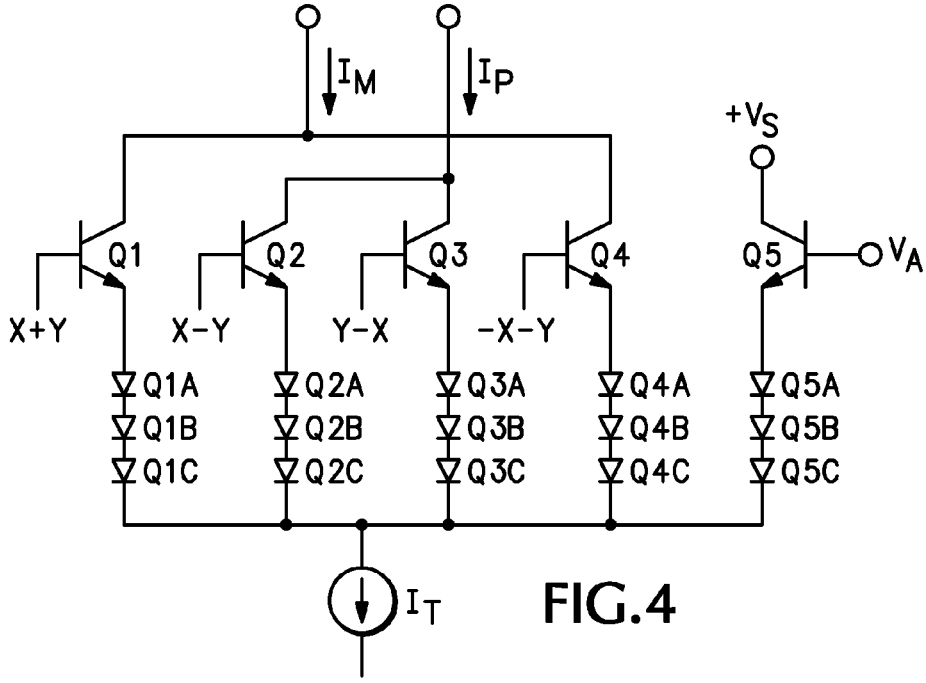
FIG. 4 illustrates an embodiment of a four-quadrant multiplier having a multi-tanh cell with additional series-connected junctions according to some of the inventive principles of this patent disclosure.

FIG. 4 illustrates another embodiment of a four-quadrant multiplier having a multi-tanh cell with additional series-connected junctions according to some of the inventive principles of this patent disclosure. The embodiment of FIG. 4 includes a common-emitter multi-tanh core Q1-Q4 having an extra transistor Q5 as in FIG. 3, but the input resistors are omitted for simplicity.

The embodiment of FIG. 4 also includes one or more additional ranks of junctions (Q1A-Q1C, Q2A-Q2C, etc.) in the form of diode-connected transistors connected between the emitters of transistors Q1-Q5 and the common-emitter node N1. The junctions in series with Q5 are scaled in the same way as Q5. The inclusion of extra junctions extends the input voltage range over which the multiplier exhibits linear behavior. Although there is a noise penalty associated with the additional ranks of junctions, the extension of linear input range has a greater impact than the increased noise. For example, for a given tail current, doubling the number of junctions in each leg from one to two doubles the voltage range over which the input voltages exert a certain effect in terms of current densities. However, assuming the noise in each junction is $e_n$, the RMS sum of the noise from the two junctions is $\sqrt{2}e_n$. Therefore, the linear input range is increased by a factor of two, but the noise only increases by a factor of $\sqrt{2}$. Doubling the number of junctions in each leg increases the dynamic range by 3 dB, and thus, including a total of four junctions in each leg as shown in FIG. 4 provides a 6 dB improvement in signal-to-noise ratio (SNR). Moreover, in addition to improving the SNR, the quadrupling of the input voltage range may result in a circuit that can directly accept user-level signals, e.g., ±500 mV.

Although the increased number of transistors may initially seem to introduce a possibility of device mismatches, the large number of devices may actually result in self-canceling deviations and thus, there may be no performance penalty from a device matching point of view. Moreover, the increased number of devices may enable more robust cross-quadding arrangements. Note that the effective area of the combination of Q5, Q5A, etc. is the geometric mean of the emitter areas, and thus, may be achieved through various combinations of device sizes.

Figure 5:
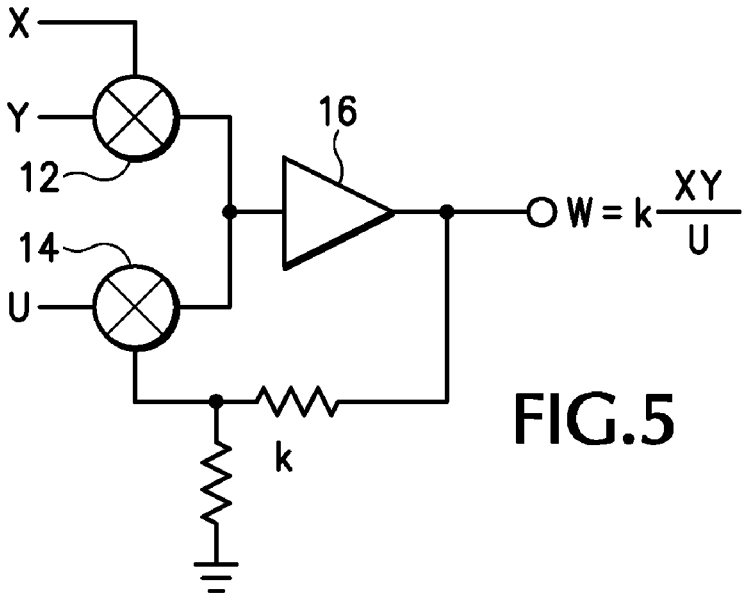
FIG. 5 illustrates an embodiment of a circuit having dual multipliers according to some of the inventive principles of this patent disclosure.

FIG. 5 illustrates an embodiment of a circuit having dual multipliers according to some of the inventive principles of this patent disclosure. The circuit of FIG. 5 includes two identical multipliers 12 and 14. The first multiplier 12 receives X and Y inputs, and the second multiplier 14 receives a U input and a feedback input. The outputs of the multipliers are combined at the input to a buffer 16 which provides a final output signal W. The output is fed back to the second multiplier through an attenuator having an attenuation factor K. The final output may be expressed as follows:

$$W = K\frac{XY}{U} \quad \text{(Eq. 6)}$$

where X and Y are multiplier inputs and U is a scaling input.

An advantage of the arrangement of FIG. 5 is that nonlinearities in the multipliers may be canceled through the use of identical multipliers. If a reference signal is applied as the U input, and an integrating buffer is used, the feedback loop servos the system to force the outputs of the two multiplier cells to be equal. Changing the attenuation factor in the feedback path changes the gain of the system without affecting the linearity.

Figure 6:
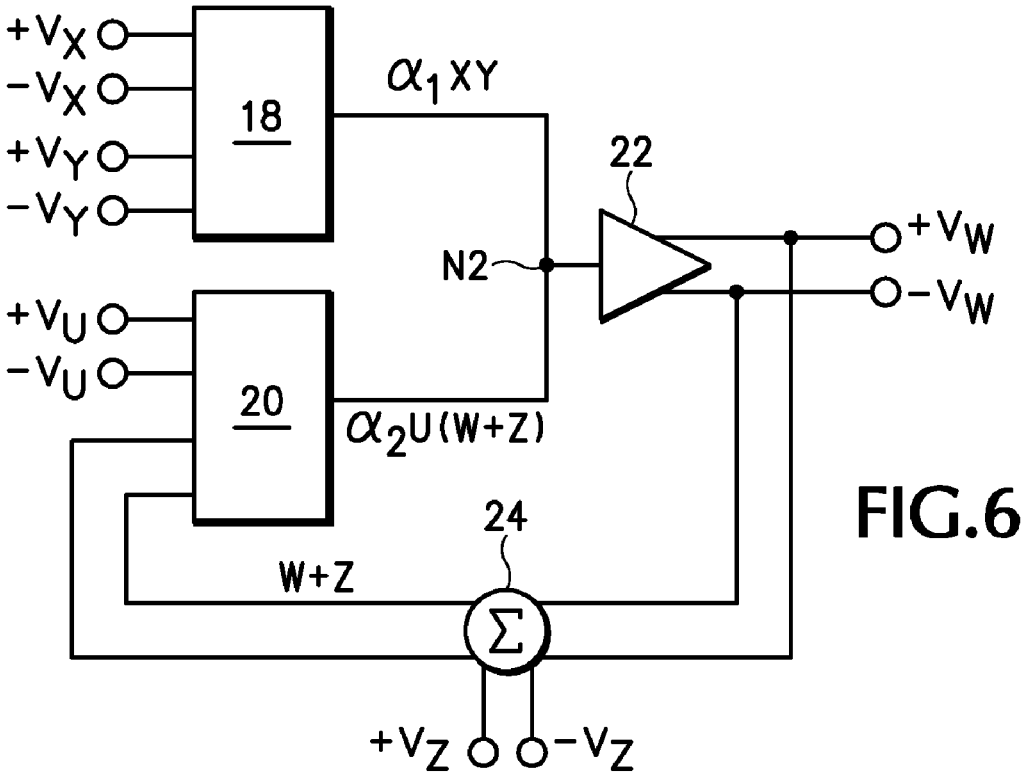
FIG. 6 illustrates another embodiment of a circuit having dual multipliers according to some of the inventive principles of this patent disclosure.

The inventive principles relating to multi-tanh cells having extra transistors may be utilized in a dual multiplier feedback arrangement as illustrated in FIG. 5 to provide a robust and versatile multiplier system with synergistic properties. FIG. 6 illustrates an embodiment of such a system according to some of the inventive principles of this patent disclosure.

The system of FIG. 6 includes two identical multipliers 18 and 20 based on multi-tanh cells having extra transistors to dynamically divert tail current according to the principles described above with reference to FIGS. 2-4. The X and Y inputs are applied to the first multiplier as differential voltage signals $\pm V_X$ and $\pm V_Y$. A scaling signal U is applied to the second multiplier as a differential voltage signal $\pm V_U$. The other input to the second multiplier is provided by a summing circuit 24 which combines the final output signal W with an offset signal Z. The output of the first multiplier 18 may be expressed as $\alpha_1 XY$ where $\alpha_1$ is a scaling factor determined by the tail current through the first multiplier. The output of the second multiplier may be expressed as $\alpha_2 U(W+Z)$ where $\alpha_2$ is the scaling factor of the second multiplier.

The outputs of the first and second multipliers are combined at an integrating node N2 which may be a simple summing node or, in the case of a differential embodiment, a pair of summing nodes. A buffer 22 provides the final output W as a differential voltage $\pm V_W$. The integrating action of the buffer forces the outputs of the multipliers to be equal. Assuming the scaling factors of the two multipliers are made equal, $\alpha_1=\alpha_2$, and the output may be expressed as follows:

$$W = \frac{XY}{U} + Z \quad \text{(Eq. 7)}$$

Thus, the architecture of FIG. 6 enables multiplication through the X and Y inputs and division through the U input, and also provides an offset through the Z input. The U input may alternatively be referenced to a high-accuracy reference signal. The multipliers 18 and 20 have a wide dynamic range due to the current splitting arrangement of the extra transistors, and the use of two such multiplier cells, one of which is in a feedback loop, cancels nonlinearities, noise and drift in the first multiplier cell. The result is a robust and flexible solution that provides a high level of accuracy and is suitable for use in modulators, demodulators, analog computation systems, etc. The simplistic nature of the multi-tanh multiplier cells enables the system to operate at high frequencies without sacrificing linearity. Moreover, the symmetric architecture of the multi-tanh multiplier cells eliminates problems associated with translinear multipliers such as amplitude and delay imbalances, distortion due to mismatches and ohmic resistances, temperature disparities in SOI implementations, etc.

The inventive principles of this patent disclosure have been described above with reference to some specific example embodiments, but these embodiments can be modified in arrangement and detail without departing from the inventive concepts. For example, some transistors have been illustrated as bipolar junction transistors (BJTs) of specific polarities, but MOS and other types and polarities of devices may be used as well. Thus, the terms base, emitter and collector are understood to refer to the corresponding terminals of other types of transistors. Area ratios may be realized with actual device sizes, or they may be realized as synthesized area ratios, collective unit devices, etc. Thus, emitter area refers to effective emitter area. Likewise, the emitters of the transistors in a common-emitter multi-tanh cell may be connected directly to the common-emitter node, which itself may include multiple nodes, or coupled indirectly through other components, e.g., emitter resistors.

As a further elaboration, according to some inventive principles of this patent disclosure, four resistors may be tied from the emitters of Q1-Q4 to a common dangling node. Such resistors would exert an expansion of the transfer function to work against the compression at high inputs, albeit at the expense of some temperature sensitivity which may be minimized by choosing an appropriate temperature shape for the tail currents.

The output from a multiplier cell according to some inventive principles of this patent disclosure may be obtained by using nothing more than low-value resistive loads at the summed collector outputs. In other embodiments, cascodes may be included between the core collectors and the system outputs to minimize the Miller multiplication of the parasitic capacitance that the summing nodes are burdened with. In more demanding applications, a broadband transimpedance output stage may be utilized, such as the triple Darlington-type arrangement shown in FIGS. 17 and 18 of U.S. Patent Application Publication No. 2005/0030121 by the same inventor as the present patent disclosure, which is incorporated by reference.

Since the embodiments described above can be modified in arrangement and detail without departing from the inventive concepts, such changes and modifications are considered to fall within the scope of the following claims.

The invention claimed is:

1. A circuit comprising:

a first multi-tanh cell having a first common-emitter node to receive a first bias current;

a first extra transistor coupled to the first common-emitter node to dynamically divert a portion of the first bias current from the first multi-tanh cell;

a second multi-tanh cell having a second common-emitter node to receive a second bias current;

a second extra transistor coupled to the second common-emitter node to dynamically divert a portion of the second bias current from the second multi-tanh cell; and first and second input networks arranged to cause the first and second multi-tanh cells to operate as multipliers;

where:

the outputs of the first and second multi-tanh cells are coupled together;

the first multi-tanh cell is arranged to multiply a first input signal and a second input signal;

the second multi-tanh cell is arranged to multiply a third input signal and a feedback signal;

the outputs of the first and second multi-tanh cells are coupled together in a summing configuration;

the circuit further comprises an integrating buffer to generate an output signal in response to the outputs of the first and second multi-tanh cells; and the circuit further comprises a summing circuit to generate the feedback signal in response to the output signal and a fourth input signal.

2. The circuit of claim 1 where the first extra transistor is arranged to dynamically divert a portion of the first bias current in response to one or more of the X and Y signals.

3. The circuit of claim 2 where the input network comprises:

a first pair of resistors coupled between a first combination of input terminals and the base of a first transistor in the first multi-tanh cell; and a second pair or resistors coupled between a second combination of input terminals and the base of a second transistor in the first multi-tanh cell.

4. The circuit of claim 3 where the input network further comprises:

a third pair of resistors coupled between a third combination of input terminals and the base of a third transistor in the first multi-tanh cell; and a fourth pair or resistors coupled between a fourth combination of input terminals and the base of a fourth transistor in the first multi-tanh cell.

5. The circuit of claim 3 where the one or more of the X and Y signals are coupled to the base of the first extra transistor through one or more resistors.

6. The circuit of claim 1 where the first extra transistor has an emitter area that is greater than the emitter area of any transistor in the first multi-tanh cell.

7. The circuit of claim 1 where the first multi-tanh cell includes one or more extra junctions coupled between each transistor and the first common-emitter node.

8. The circuit of claim 7 further comprising one or more additional extra junctions coupled between the first extra transistor and the first common-emitter node.

9. The circuit of claim 1 where the first and second multi-tanh cells have the same multiplier gain.

10. The circuit of claim 1 further comprising a current source coupled to the common-emitter node to provide the bias current to the first multi-tanh cell.

11. The circuit of claim 1 where the first multi-tanh cell comprises:

a first transistor having an emitter coupled to the first common-emitter node, a collector coupled to a first output terminal, and a base coupled to a first input through a first resistor and to a second input through a second resistor;

a second transistor having an emitter coupled to the first common-emitter node, a collector coupled to a second output terminal, and a base coupled to the first input through a third resistor and to a third input through a fourth resistor;

a third transistor having an emitter coupled to the first common-emitter node, a collector coupled to the second output terminal, and a base coupled to a fourth input through a fifth resistor and to the second input through a sixth resistor;

a fourth transistor having an emitter coupled to the first common-emitter node, a collector coupled to the first output terminal, and a base coupled to the fourth input through a seventh resistor and to the third input through an eighth resistor; and a current source coupled to the first common-emitter node.

12. The circuit of claim 11 where the base of the first extra transistor is coupled to the first input through a ninth resistor, to the second input through a tenth resistor, to the third input through an eleventh resistor, and to the fourth input through a twelfth resistor.

13. The circuit of claim 1 further comprising a plurality of resistors, each resistor coupled between an emitter of a transistor in the first multi-tanh cell and a common node.

14. A method comprising:

operating a first multi-tanh cell having a first common-emitter node to receive a first bias current;

splitting the first bias current between the first multi-tanh cell and a first extra transistor in response to the product of a first input signal and a second input signal applied to the first multi-tanh cell;

operating a second multi-tanh cell having a second common-emitter node to receive a second bias current;

splitting the second bias current between the second multi-tanh cell and a second extra transistor in response to the product of a third input signal and a feedback signal applied to the second multi-tanh cell;

combining the outputs of the first and second multi-tanh cells to generate an intermediate signal;

integrating the intermediate signal to generate an output signal; and summing the output signal and a fourth input signal to generate the feedback signal.

15. The method of claim 14 further comprising driving the first extra transistor in response to a mean of the X and Y signals applied to the first multi-tanh cell.

16. A circuit comprising:

a first multi-tanh cell having a first common-emitter node to receive a first bias current;

a first extra transistor coupled to the first common-emitter node to dynamically divert a portion of the first bias current from the first multi-tanh cell;

a second multi-tanh cell having a second common-emitter node to receive a second bias current and an output coupled to an output of the first multi-tanh cell;

a second extra transistor coupled to the second common-emitter node to dynamically divert a portion of the second bias current from the second multi-tanh cell;

a buffer having an input coupled to the outputs of the first and second multi-tanh cells; and a feedback network arranged to form a feedback loop with the second multi-tanh cell and the buffer;

where:

the first multi-tanh cell is arranged outside of the feedback loop;

the feedback network has an attenuation factor K;

the buffer comprises an integrating buffer;

the first multi-tanh cell is arranged to multiply a first input signal and a second input signal;

the second multi-tanh cell is arranged to multiply a third input signal and a feedback signal; and the buffer is arranged to generate an output signal having the form kXY/U, where k is a constant, X comprises the value of the first input signal, Y comprises the value of the second input signal, and U comprises the value of the third input signal.

* * * * *

UNITED STATES PATENT AND TRADEMARK OFFICE

CERTIFICATE OF CORRECTION

PATENT NO. : 7,795,948 B2
APPLICATION NO. : 11/768142
DATED : September 14, 2010
INVENTOR(S) : Barrie Gilbert It is certified that error appears in the above-identified patent and that said Letters Patent is hereby corrected as shown below:

Column 7, line 18, the words "X and Y" should read -- first and second input --;
Column 7, lines 35-36, the words "X and Y" should read -- first and second input --;
Column 8, line 34, the words "X and Y" should read -- first and second input --.

Signed and Sealed this

Thirtieth Day of November, 2010

David J. Kappos

David J. Kappos
*Director of the United States Patent and Trademark Office*